US009225088B2

(12) United States Patent
Hsu et al.

(10) Patent No.: US 9,225,088 B2
(45) Date of Patent: Dec. 29, 2015

(54) LOWER PROFILE CARD EDGE CONNECTOR

(71) Applicant: HON HAI PRECISION INDUSTRY CO., LTD., New Taipei (TW)

(72) Inventors: Kuo-Chun Hsu, New Taipei (TW); Zhen-Hua Wang, Kunshan (CN); Feng-Lan Liu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/150,785

(22) Filed: Jan. 9, 2014

(65) Prior Publication Data

US 2014/0194006 A1 Jul. 10, 2014

(30) Foreign Application Priority Data

Jan. 9, 2013 (CN) ..... 2013 2 0009600

(51) Int. Cl.

| | |
|---|---|
| ***H01R 13/66*** | (2006.01) |
| ***H01R 12/71*** | (2011.01) |
| ***H01R 12/72*** | (2011.01) |
| *H01R 13/64* | (2006.01) |

(52) U.S. Cl.

CPC ..... *H01R 12/716* (2013.01); *H01R 12/721* (2013.01); *H01R 13/64* (2013.01)

(58) Field of Classification Search

CPC ..... H01R 12/722; H01R 27/76; H01R 13/60; H01R 13/40; H01R 13/73

USPC ..... 439/620.2, 630, 633, 637, 629, 83

See application file for complete search history.

(56) References Cited

U.S. PATENT DOCUMENTS

| | | | | |
|---|---|---|---|---|
| 6,089,904 | A * | 7/2000 | Wu | 439/495 |
| 6,135,797 | A * | 10/2000 | McCleerey et al. | 439/248 |
| 6,644,995 | B1 * | 11/2003 | Jones et al. | 439/260 |
| 6,767,235 | B2 * | 7/2004 | Wu | 439/328 |
| 6,877,995 | B1 * | 4/2005 | Chen | 439/76.1 |
| 7,794,259 | B2 * | 9/2010 | Zhu et al. | 439/327 |
| 7,909,644 | B1 * | 3/2011 | Li et al. | 439/541.5 |
| 2002/0123268 | A1 * | 9/2002 | Kuroda et al. | 439/637 |
| 2005/0142948 | A1 * | 6/2005 | Lee | 439/630 |

(Continued)

FOREIGN PATENT DOCUMENTS

| | | | |
|---|---|---|---|
| CN | 201490411 | U | 5/2010 |
| CN | 201490411 | U * | 5/2010 |

(Continued)

*Primary Examiner* — Abdullah Riyami
*Assistant Examiner* — Nader J Alhawamdeh
(74) *Attorney, Agent, or Firm* — Wei Te Chung; Ming Chieh Chang

(57) ABSTRACT

A card edge connector for being retained into a notch of a print circuit board includes an insulative housing defining a central slot extending along a longitudinal direction, a first wall and a second wall located on the opposite sides of the central slot and a fitting portion extending downwardly into the notch from a bottom portion of the first wall, the fitting portion defining a plurality of first terminal slots and the second wall defining a plurality of second terminal slots. A plurality of first terminals are received in the first terminal slots, and a plurality of second terminals are received in the second terminal slots. Each first terminal defines a first retaining portion received in the first terminal slot and a first soldering portion extending out of the housing forwardly, each second terminal defines a second soldering portion rearwardly extending out of the housing.

20 Claims, 5 Drawing Sheets

(56) References Cited

U.S. PATENT DOCUMENTS

| | | | | |
|---|---|---|---|---|
| 2009/0061689 | A1* | 3/2009 | Lee et al. | 439/629 |
| 2009/0104818 | A1* | 4/2009 | Wu et al. | 439/638 |
| 2009/0264019 | A1* | 10/2009 | Sakamoto | 439/658 |
| 2011/0130041 | A1* | 6/2011 | Chen et al. | 439/630 |
| 2011/0136388 | A1* | 6/2011 | Fu et al. | 439/637 |
| 2011/0300759 | A1* | 12/2011 | Ngo | 439/630 |
| 2012/0115369 | A1* | 5/2012 | Liu | 439/630 |
| 2012/0135630 | A1* | 5/2012 | Yoshimi et al. | 439/372 |
| 2013/0005190 | A1* | 1/2013 | Blanchfield et al. | 439/630 |
| 2013/0012071 | A1* | 1/2013 | Nakazura et al. | 439/630 |
| 2013/0084753 | A1* | 4/2013 | Huang et al. | 439/633 |

FOREIGN PATENT DOCUMENTS

| | | |
|---|---|---|
| CN | 202217811 U | 5/2012 |
| TW | M376978 | 3/2010 |

* cited by examiner

LOWER PROFILE CARD EDGE CONNECTOR

BACKGROUND OF THE INVENTION

1. Field of the Invention

The present invention relates to a card edge connector, and more particularly to a lower profile card edge connector.

2. Description of the Related Art

Chinese Utility Pat. No. 202217811U issued on May 9, 2012, discloses a card edge connector including an insulative housing, a row of first terminals and a row of second terminals. A first elastic portion of each first terminal extends forwardly from a first retaining portion to a first contacting portion without folding and a second elastic portion of each second terminal extends forwardly from a second retaining portion to a second contacting portion without folding. The first and second elastic portions both extend along a non-back folding line so as to reduce the height of the first and second terminals which can synchronously reduce the thickness of the card edge connector.

However, the height of the connector is desired to be lower and lower in nowadays, therefore, an improved card edge connector is highly desired to meet overcome the requirement.

BRIEF SUMMARY OF THE INVENTION

An object of the present invention is to provide a lower profile card edge connector having more space used for receiving a row of lower terminals.

In order to achieve above-mentioned object, a card edge connector for being retained into a notch of a print circuit board, comprising an insulative housing defining a central slot extending along a longitudinal direction, a first wall and a second wall located on the opposite sides of the central slot and a fitting portion extending downwardly into the notch from a bottom portion of the first wall, the fitting portion defining a plurality of first terminal slots and the second wall defining a plurality of second terminal slots. A plurality of first terminals are retained in the insulative housing and received in the first terminal slots, and a plurality of second terminals are retained in the insulative housing and received in the second terminal slots. Wherein each first terminal defines a first retaining portion received in the first terminal slot of the fitting portion and a first soldering portion extending out of the housing forwardly from the first wall, each second terminal defines a second soldering portion rearwardly extending out of the housing.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
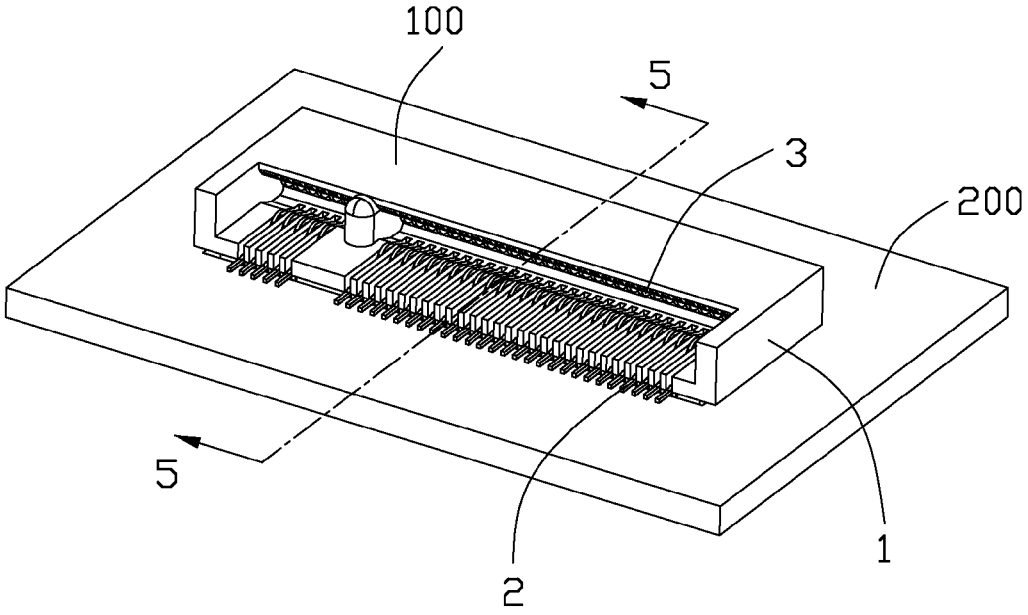
FIG. 1 is a perspective view of a card edge connector assembly including a printed circuit board and a card edge connector mounted on the PCB in accordance with the present invention.
Figure 2:
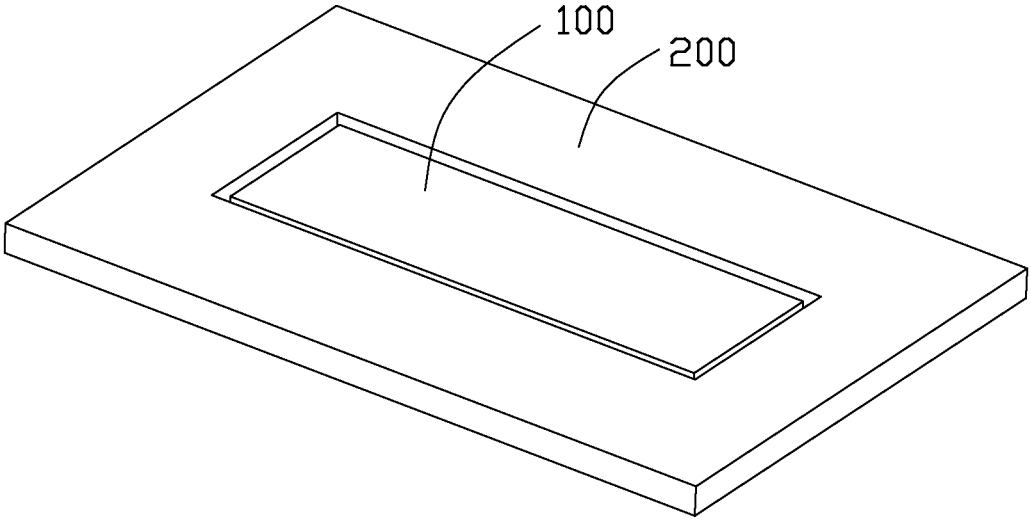
FIG. 2 is another perspective view of the card edge connector assembly shown in FIG. 1.

Reference will now be made to the drawing figures to describe a preferred embodiment of the present invention in detail. Referring to FIGS. 1 to 2, a card edge connector assembly including a card edge connector 100 and a printed circuit board/motherboard 200 on which the card edge connector 100 mounted is disclosed in accordance with the present invention. The card edge connector 100 for accommodating an electrical card is used to be soldered on the motherboard 200 of an electronic device in order to achieve the electronic transmission between the electrical card and the motherboard 200. This electronic device can be thinner laptop or other similar electronic products. The card edge connector 100 includes an insulative housing 1, a plurality of first terminals 2 and a plurality of second terminals 3 retained in the insulative housing 1.

Figure 3:
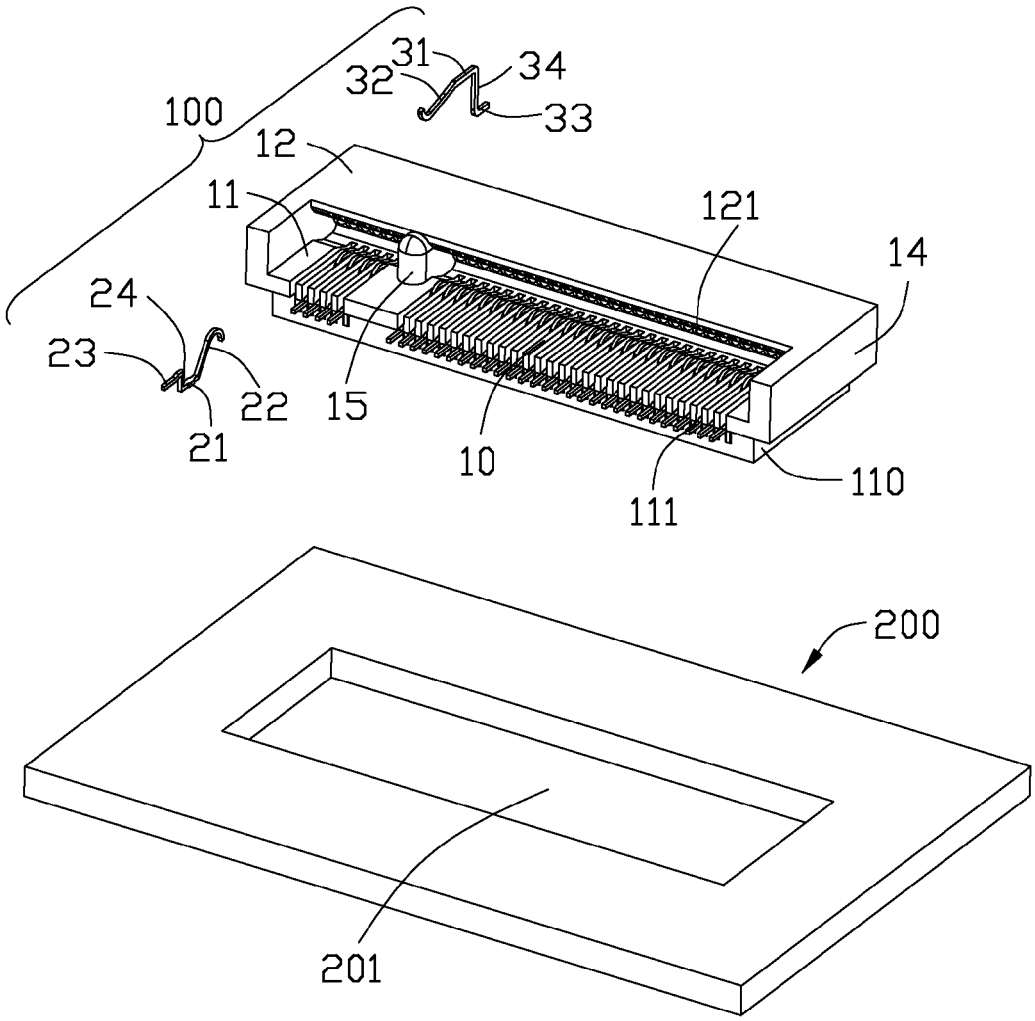
FIG. 3 is a partially exploded perspective view of the card edge connector assembly shown in FIG. 1.
Figure 4:
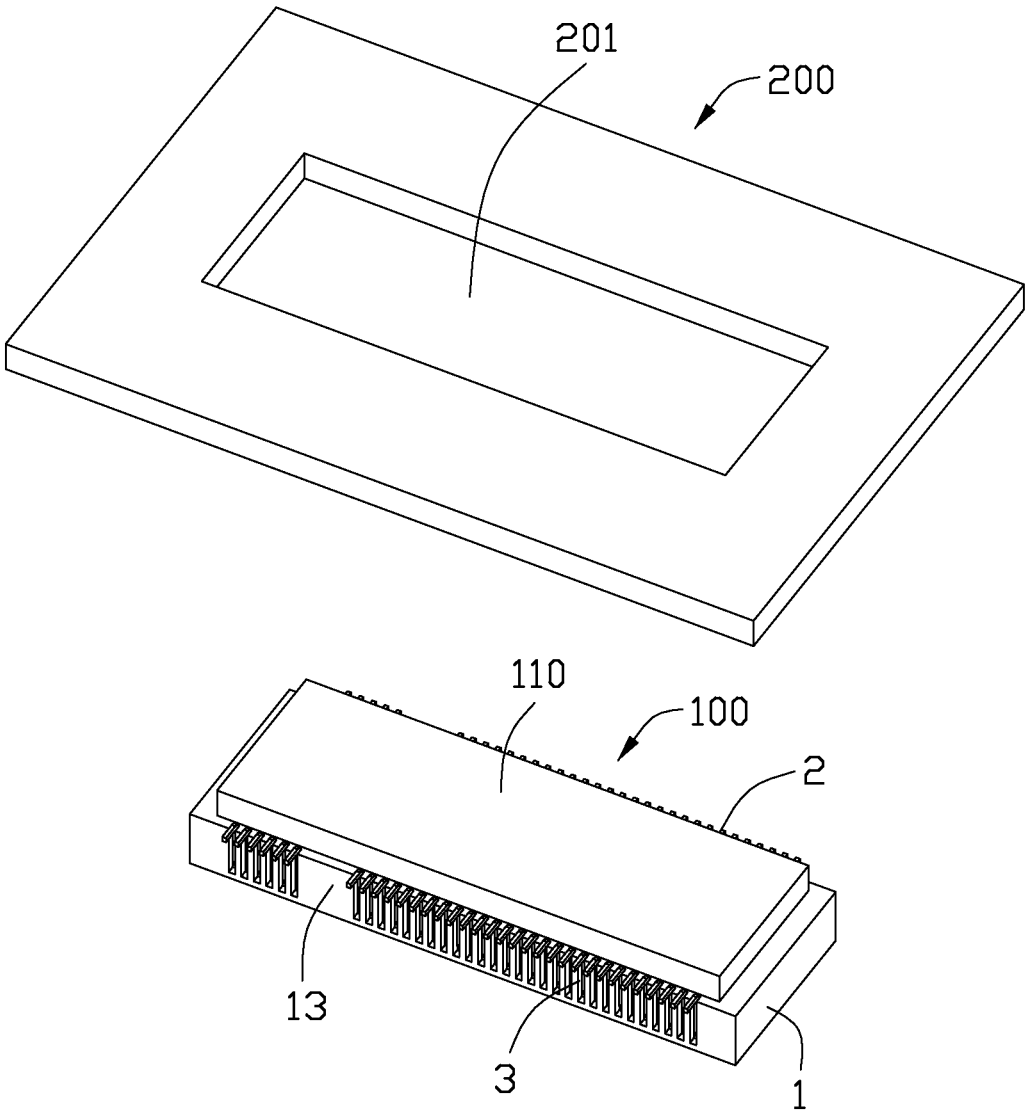
FIG. 4 is an exploded perspective view of the card edge connector assembly of FIG. 2 showing the card edge connector separated from the PCB.
Figure 5:
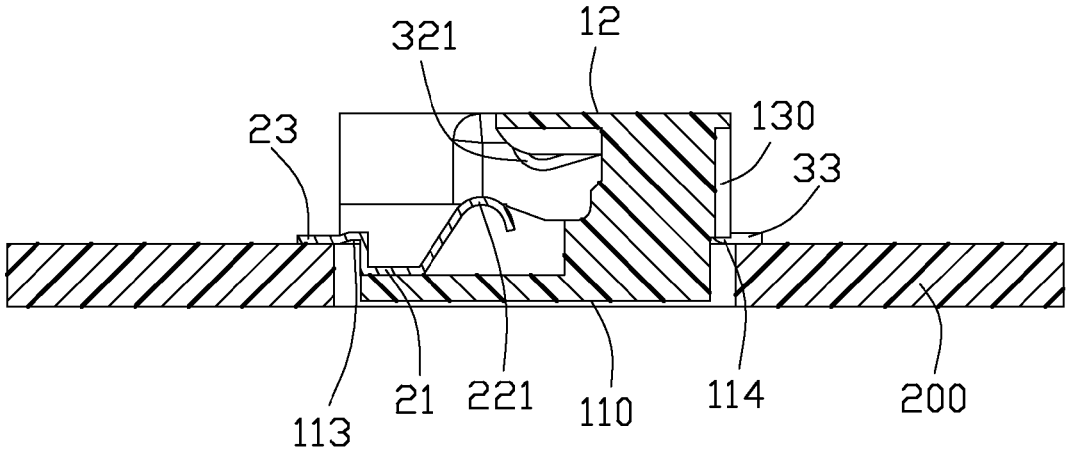
FIG. 5 is a cross-sectional view of the card edge connector assembly take along line 5-5 shown in FIG. 1.

Referring to FIGS. 3 to 5, the insulative housing 1 is elongated shape and includes a first wall 11 and a second wall 12 opposite to the first wall 11, a rear wall 13 connecting to the first wall 11 and the second wall 12, and a pair of side walls 14 respectively located on two longitudinal ends of the first and second walls 11, 12. A narrow central slot 10 extends along a longitudinal direction of the connector is located between the first wall 11 and the second wall 12 for receiving the electrical card, and the central slot 10 defines a key 15 close to one of the side walls 14 to prevent the electrical card from being inserted into the central slot 10 in an incorrect direction. The first wall 11 forwardly projects beyond the second wall 12 so as to form an obliquely upward insertion port in the front of the central slot 10. The first walls 11 and the second walls 12 are located at opposite sides of the central slot 10 respectively. In a front-to-rear direction, the first wall 11 forwardly projects beyond the second wall 12, which means that the length of the first wall 11 is different from the length of the second wall 12 in the front-to-rear direction so as to form an obliquely upward insertion port in the front of the central slot 10 to facilitate the obliquely insertion of the electrical card.

A fitting portion 110 extends downwardly from the bottom portion of the first wall 11 and located in a notch or through opening 201 of the motherboard 200, wherein the notch 201 is bounded by corresponding front, rear and side edge sections of the printed circuit board which surrounds the notch 201, and the fitting portion 110 does not exceed the lower surface of the motherboard 200. The fitting portion 110 defines a plurality of first terminal slots 111 running through the first wall 11 and opening to the central slot 10, and the second wall 12 defines a plurality of second terminal slots 121 opening to the central slot 10 and each offsets from a corresponding first terminal slot 111 in the longitudinal direction. Each second terminal slot 121 communicates with the central slot 10 and runs through the rear wall 13 to form a fixing slot 130 in the rear wall 13.

The plurality of first terminals 2 are assembled into the first terminal slots 111 of the first wall 11. Each first terminal 2 defines a first retaining portion 21 received in the fitting portion 110, a first contacting arm 22 extending rearwardly from the first retaining portion 21, a first soldering portion 23 forwardly extending out of the first wall 11 and a first connecting portion 24 connecting with the first retaining portion 21 and the first soldering portion 23. The first contacting arm 22 is resilient and has a first contacting portion 221 upwardly projecting into the central slot 10. The first retaining portion 21 is disposed lower than a plane in which the first soldering portion 23 disposed, and the first soldering portion 23 is located between the first retaining portion 21 and the first contacting arm 22 in a vertical direction perpendicular to the front-to-rear direction and the longitudinal direction. The first soldering portion 23 extends outside of the insulative housing 1 to horizontally arrange adjacent to the notch 201 to be mounted on the motherboard 200.

The plurality of second terminals 3 are assembled into the second terminal slots 121 of the second wall 12 from the rear wall 13 in a rear-to-front direction. Each second terminal 3 defines a second retaining portion 31 received in the second terminal slots 121, a second contacting arm 32 bending and extending forwardly from the second retaining portion 31, a second soldering portion 33 extending rearwardly from the second retaining portion 31 and a second connecting portion 34 received in the fixing portion 130 and connecting with the second retaining portion 31 and the second soldering portion 33. The second contacting arm 32 is resilient and has a second contacting portion 321 projecting into the central slot 10, the second retaining portion 31 is higher than the second contacting arm 32 and the second soldering portion 33 in the vertical direction, and the second soldering portion 33 rearwardly extends outside of the insulative housing 1 for locating on the motherboard 200 to adjacent the notch 201.

The first terminal 2 can be elastic deformed downwardly in the first terminal slot 111 when the electrical card is inserted into the central slot 10. The fitting portion 110 of the first wall 11 and the first retaining portion 21 of the first terminal 2 are both located in the notch 201 so that the first contacting arm 22 of the first terminal 2 can produce larger elastic force with less elastic deformation so as to achieve a larger clip force on the electrical card. It can increase the receiving space of the first terminal 2 without increasing the height of the card edge connector 100 so that the card edge connector 100 is adapted for miniaturization trends. At the same time the front edge 113 of the first wall 11 and the fitting portion 110 can form step-shaped, the card edge connector 100 can be mounted onto the motherboard 200 with the front edge 113 located on a side edge of the notch 201 to set the fitting portion 110 into the notch 201. The rear edge 114 of the rear wall 13 can be also set step-shaped to mount on another side edge of the notch 201 of the motherboard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector assembly comprising:

a printed circuit board defining a through opening extending through opposite upper and lower surfaces of said printed circuit board in a vertical direction and circumferentially bounded by corresponding edge sections of the printed circuit board essentially composed of opposite front and rear edge sections and opposite side edge sections;

an elongated insulative housing defining a horizontal card receiving slot located between opposite upper and lower walls in a longitudinal direction perpendicular to said vertical direction, and forwardly communicating with an exterior in a front-to-back direction perpendicular to both said longitudinal direction and said vertical direction;

a plurality of upper contacts disposed in the upper wall with resilient upper contacting sections extending into the card receiving slot and upper tail sections soldered to the printed circuit board around the rear edge sections; and a plurality of lower contacts disposed in the lower wall with resilient lower contacting sections extending into the card receiving slot and lower tail sections soldered to the printed circuit board around the front edge sections; wherein a lower portion of the lower wall of the housing being a fitting portion, is disposed and fully circumferentially surrounded in the through opening; wherein the housing forms a pair of step structures by two lateral sides of the fitting portion to be downwardly seated upon the upper surface of the printed circuit board around the corresponding side edge sections; wherein the lower wall defines a plurality of lower passageways configured to have the lower contacts rearwardly assembled thereinto in said front-to-back direction.

2. The card edge connector assembly as claimed in claim 1, wherein a bottom face of the lower wall is located at a level higher not lower than that of the lower surface of the printed circuit board.

3. The card edge connector assembly as claimed in claim 1, wherein the horizontal card receiving slot is located at a level higher than that of the upper surface of the printed circuit board.

4. The card edge connector assembly as claimed in claim 1, wherein the upper wall defines a plurality of upper passageways configured to have the upper contacts forwardly assembled thereinto in a front-to-back direction perpendicular to both said vertical direction and said longitudinal direction.

5. The card edge connector assembly as claimed in claim 1, wherein both said upper tail sections and said lower tail sections are surface-mounted onto the upper surface of the printed circuit board.

6. The card edge connector assembly as claimed in claim 1, wherein the housing forms a pair of step structures beside the fitting portion confronting the upper surface of the printed circuit board around the corresponding front and rear edge sections.

7. The card edge connector assembly as claimed in claim 1, wherein the upper wall is rearwardly offset from the lower wall for compliance with a slantingly inserted memory module, and wherein the upper contacting sections of the upper contacts are located behind the lower contacting sections of the lower contacts in said front-to-back direction.

8. The card edge connector assembly as claimed in claim 1, wherein each of the lower contacts includes a lower retaining section between the corresponding lower contacting section and the corresponding lower tail section in the front-to-back direction, and said lower retaining section is lower than both said corresponding lower contacting section and said corresponding lower tail section in the vertical direction.

9. A card edge connector assembly comprising:

a printed circuit board defining a through opening extending through opposite upper and lower surfaces of said printed circuit board in a vertical direction and circumferentially bounded by corresponding edge sections of the printed circuit board essentially composed of opposite front and rear edge sections and opposite side edge sections;

an elongated insulative housing defining a horizontal card receiving slot located between opposite upper and lower walls in a longitudinal direction perpendicular to said vertical direction, and forwardly communicating with an exterior in a front-to-back direction perpendicular to both said longitudinal direction and said vertical direction;

a plurality of upper contacts disposed in the upper wall with resilient upper contacting sections extending into the card receiving slot and upper tail sections soldered to the printed circuit board around the rear edge sections; and a plurality of lower contacts disposed in the lower wall with resilient lower contacting sections extending into the card receiving slot and lower tail sections soldered to the printed circuit board around the front edge sections; wherein a lower portion of the lower wall of the housing being a fitting portion, is disposed and fully circumferentially surrounded in the through opening; wherein the lower wall defines a plurality of lower passageways configured to have the lower contacts rearwardly assembled thereinto in said front-to-back direction; wherein each of the lower contacts includes a lower retaining section between the corresponding lower contacting section and the corresponding lower tail section in the front-to-back direction, and said lower retaining section is lower than both said corresponding lower contacting section and said corresponding lower tail section in the vertical direction.

10. The card edge connector assembly as claimed in claim 9, wherein the upper wall defines a plurality of upper passageways configured to have the upper contacts forwardly assembled thereinto in said front-to-back direction.

11. The card edge connector assembly as claimed in claim 9, wherein both said upper tail sections and said lower tail sections are surface-mounted onto the upper surface of the printed circuit board.

12. The card edge connector assembly as claimed in claim 9, wherein the housing forms a pair of step structures beside the fitting portion confronting the upper surface of the printed circuit board around the corresponding front and rear edge sections.

13. The card edge connector assembly as claimed in claim 9, wherein the upper wall is rearwardly offset from the lower wall for compliance with a slantingly inserted memory module.

14. The card edge connector assembly as claimed in claim 9, wherein the upper contacting sections of the upper contacts are located behind the lower contacting sections of the lower contacts in said front-to-back direction.

15. The card edge connector assembly as claimed in claim 9, wherein a bottom face of the lower wall is located at a level higher than that of the lower surface of the printed circuit board.

16. The card edge connector assembly as claimed in claim 9, wherein the horizontal card receiving slot is located at a level higher than that of the upper surface of the printed circuit board.

17. A card edge connector assembly comprising:

a printed circuit board defining a through opening extending through opposite upper and lower surfaces of said printed circuit board in a vertical direction and circumferentially bounded by corresponding edge sections of the printed circuit board essentially composed of opposite front and rear edge sections and opposite side edge sections;

an elongated insulative housing defining a horizontal card receiving slot located between opposite upper and lower walls in a longitudinal direction perpendicular to said vertical direction and forwardly communicating with an exterior in a front-to-back direction perpendicular to both said longitudinal direction and said vertical direction;

a plurality of upper contacts disposed in the upper wall with resilient upper contacting sections extending into the card receiving slot and upper tail sections soldered to the printed circuit board around the rear edge sections; and a plurality of lower contacts disposed in the lower wall with resilient lower contacting sections extending into the card receiving slot and lower tail sections soldered to the printed circuit board around the front edge sections; wherein a lower portion of the lower wall of the housing being a fitting portion, is disposed and fully circumferentially surrounded in the through opening; wherein a bottom face of the lower wall is located at a level not lower than that of the lower surface of the printed circuit board; wherein the horizontal card receiving slot is located at a level higher than that of the upper surface of the printed circuit board.

18. The card edge connector assembly as claimed in claim 17, wherein each of the lower contacts includes a lower retaining section between the corresponding lower contacting section and the corresponding lower tail section in the front-to-back direction, and said lower retaining section is lower than both said corresponding lower contacting section and said corresponding lower tail section in the vertical direction.

19. The card edge connector assembly as claimed in claim 17, wherein the lower wall defines a plurality of lower passageways configured to have the lower contacts rearwardly assembled thereinto in said front-to-back direction, and wherein both said upper tail sections and said lower tail sections are surface-mounted onto the upper surface of the printed circuit board.

20. The card edge connector assembly as claimed in claim 17, wherein the upper contacting sections of the upper contacts are located behind the lower contacting sections of the lower contacts in said front-to-back direction.

* * * * *